United States Patent [19]

Adams

[11] 4,440,098

[45] Apr. 3, 1984

[54] WASTE MATERIAL INCINERATION SYSTEM AND METHOD

[75] Inventor: Jack C. Adams, Boca Raton, Fla.

[73] Assignee: Energy Recovery Group, Inc., Boca Raton, Fla.

[21] Appl. No.: 448,425

[22] Filed: Dec. 10, 1982

[51] Int. Cl.[3] ..... F23G 5/12

[52] U.S. Cl. ..... 110/215; 110/205; 110/212; 110/213; 110/216; 55/228; 55/260; 261/118

[58] Field of Search ..... 110/210–216, 110/244, 251, 254, 170, 171, 205; 55/89, 260, 228; 261/DIG. 54, 118

[56] References Cited

U.S. PATENT DOCUMENTS

| | | | |
|---|---|---|---|
| 3,618,299 | 11/1971 | Vincent | 55/260 |
| 3,640,054 | 2/1972 | Katz | 261/118 |
| 3,680,501 | 8/1972 | Szilagyi et al. | 110/212 |
| 3,792,671 | 2/1974 | Woods | 110/212 |
| 3,817,713 | 6/1974 | Ionescu | 55/260 |
| 3,876,399 | 4/1975 | Saponaro | 55/228 |
| 3,932,280 | 1/1976 | Anderson | 110/216 |
| 3,939,781 | 2/1976 | Adams | 110/222 |
| 4,119,046 | 10/1978 | Adams | 110/244 |
| 4,213,402 | 7/1980 | Kochey | 110/171 |
| 4,295,866 | 10/1981 | Kearny | 55/228 |

*Primary Examiner*—Henry C. Yuen
*Attorney, Agent, or Firm*—Ratner & Prestia

[57] ABSTRACT

A waste material incineration system (10) and method of combusting waste material is provided wherein system (10) includes a longitudinally directed furnace (14) having a first combustion zone (42) and a second combustion zone (44). Waste material or other fuel is inserted into furnace (14) through a furnace inlet (26) and passes by gravity assist into a vortexing pattern dependent upon the geometrical contouring of the internal walls of furnace (14) in combination with preheating air conduits (86, 88 and 90). Subsequent to vortexing in the first combustion zone (42), the substantially fully combusted gases are transported through second combustion zone (44) for insert into a heat exchanger unit (12) and then passes to a scrubber unit (34) where the exhausted gases are further cleansed to expulsion of the cleansed exhaust gases through an exhaust stack (16) to the ambient atmosphere.

48 Claims, 8 Drawing Figures

FIG. 2
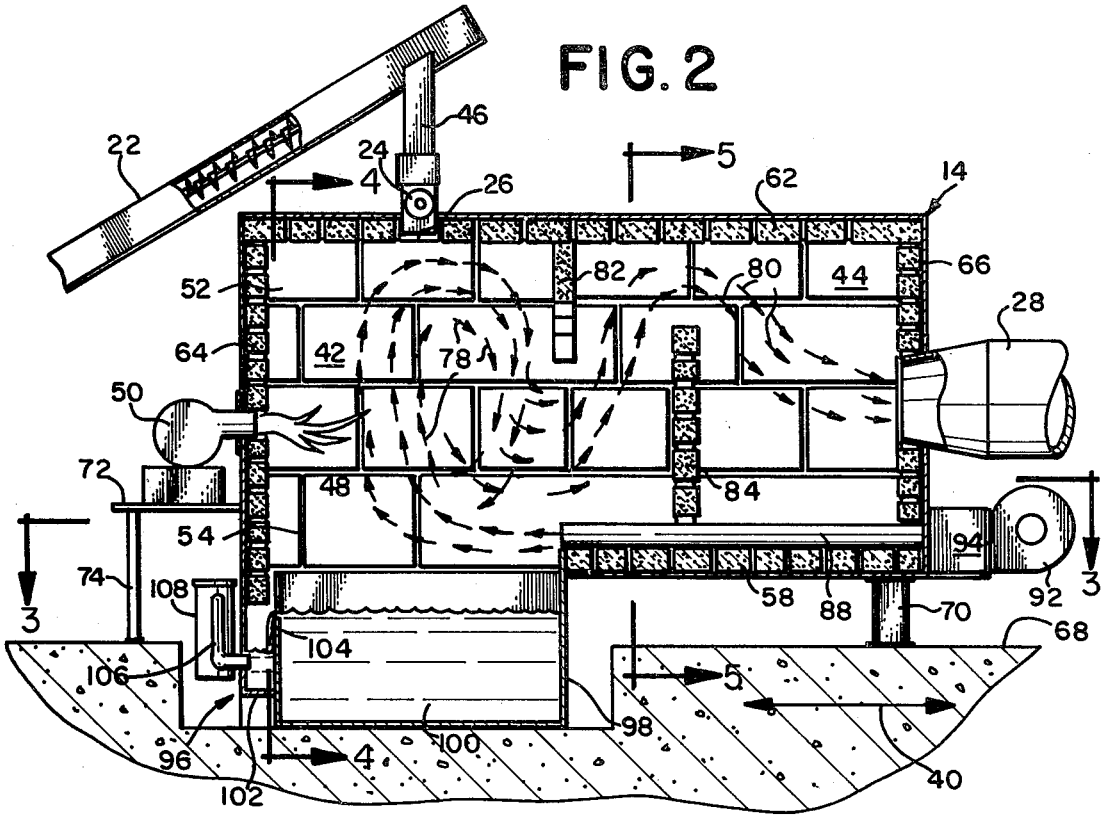
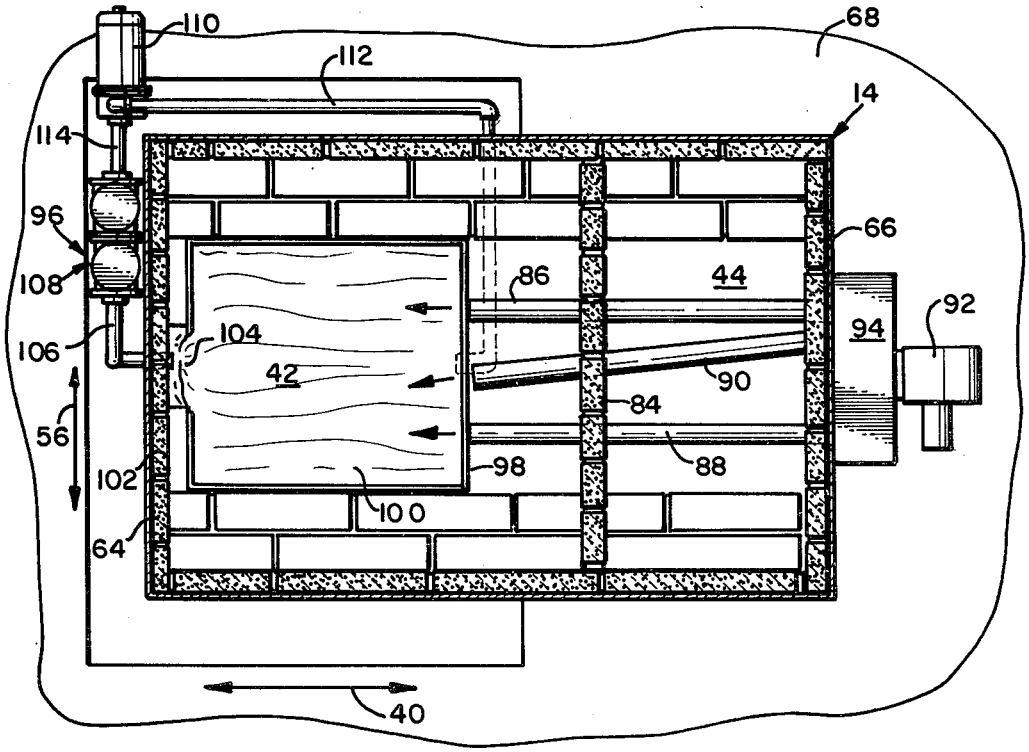
FIG. 3

WASTE MATERIAL INCINERATION SYSTEM AND METHOD

BACKGROUND OF THE INVENTION

1. Field of the Invention

This invention pertains to the field of combusting waste material or other prepared fuel. In particular, this invention relates to incinerator systems and methods of combustion which provide for substantially total combustion of the fuel or waste material within a furnace and the cleansing of the exhaust gases prior to passage to the atmosphere. More in particular, this invention relates to waste material incineration systems which maximize the time that the combusting material remains in the combustion zones in order to substantially fully create total combustion. Further, this invention pertains to incineration systems where there is provided particular geometrical contouring and air insertion techniques which cause vortexing patterns to be applied to the combusting waste material for maintaining such combusting material within the combustion zone for increased intervals of time. Still further, this invention relates to incineration systems which incorporate within the furnace a particulate removal system to remove particulate matter and uncombusted material from the initial combustion zone. Still further, this invention relates to material incineration systems which provide for downstream cleansing operations to further cleanse the exhaust gases prior to emission to the atmosphere.

2. Prior Art

Incineration systems for prepared and unprepared fuels such as waste material and methods of combusting the same, are well-known in the art. The closest prior art known to Applicant includes U.S. Pat. Nos. 3,939,781 and 4,119,046, which have the same Patentee as this invention. In U.S. Pat. No. 4,119,046, there is provided an incineration system and method wherein material is vortexed in a longitudinally directed furnace system. However, such prior art system does not provide for a helical vortexing of the material being combusted which increases the time interval that the combusting material remains in the combusting zone. Additionally, this prior art system does not provide for a particulate removal mechanism for removing particulate material directly from the first combustion zone. Still further, this type of prior art system does not provide for a further cleansing of the exhaust gases prior to egress to the atmosphere.

In U.S. Pat. No. 3,939,781, there is provided an elongated incineration system which does rely on vortexing of material within a combustion zone. However, such vortexing is provided in a manner where the vortexing is about a central axis line of the defined longitudinal direction of the incinerator. Such vortexing does not provide for a vortexing pattern which maximizes the time interval within which the combusting material is maintained within a combustion zone. Additionally, such prior art system does not provide for the continuous particulate removal system located below the combustion zone to continuously remove contaminants and particulate material from the initial combustion zone.

In some other prior incineration systems, materials being combusted are vortexed for predetermined intervals of time, which are empirically derived. Such vortexing for specific intervals of time does not maximize the combustion efficiency of such systems. Thus, in such prior art systems, the vortexing itself is directed to a time interval and is not directed to the primary function and objective of maintaining the combusting material in a combustion zone until it is fully or substantially fully combusted. In such prior art systems, products of combustion have been found to be composed largely of non-combusted material.

In still other prior art systems, material being combusted is vortexed during the combustion process. However, these prior art systems merely vortex and then remove the partially combusted material. These prior art systems do not provide for re-circulation of the combusting materials until such are substantially fully combusted. Thus, such systems generally include large amounts of non-combusted materials found in the end products of the incineration systems.

In other prior art incineration systems, there is no vortexing of the combusting material and the material is merely inserted into a furnace and then impinged by a flame front for some predetermined time interval. In such cases, there are large quantities of material which are not fully combusted during the incineration process.

SUMMARY OF THE INVENTION

A waste material incineration system which includes a longitudinally directed furnace having a first combustion zone and a second combustion zone. The waste material is inserted into the first combustion zone through a material inlet and falls into the first combustion zone by gravity assist. A mechanism for vortexing the waste material is mounted within the first combustion zone and such vortexing mechanism includes a mechanism for inserting pre-heated air into the first combustion zone with the pre-heating air mechanism extending adjacent the second combustion zone. The incineration system further includes a mechanism for removing particulate material from the first combustion zone.

BRIEF DESCRIPTION OF THE DRAWINGS

FIG. 2 is a sectional view of the waste material incineration system furnace showing the internal flow patterns of the combusting material within the furnace;

FIG. 3 is a sectional view of the incineration system furnace taken along the section line 3—3 of FIG. 2;

DESCRIPTION OF THE PREFERRED EMBODIMENTS

Figure 1:
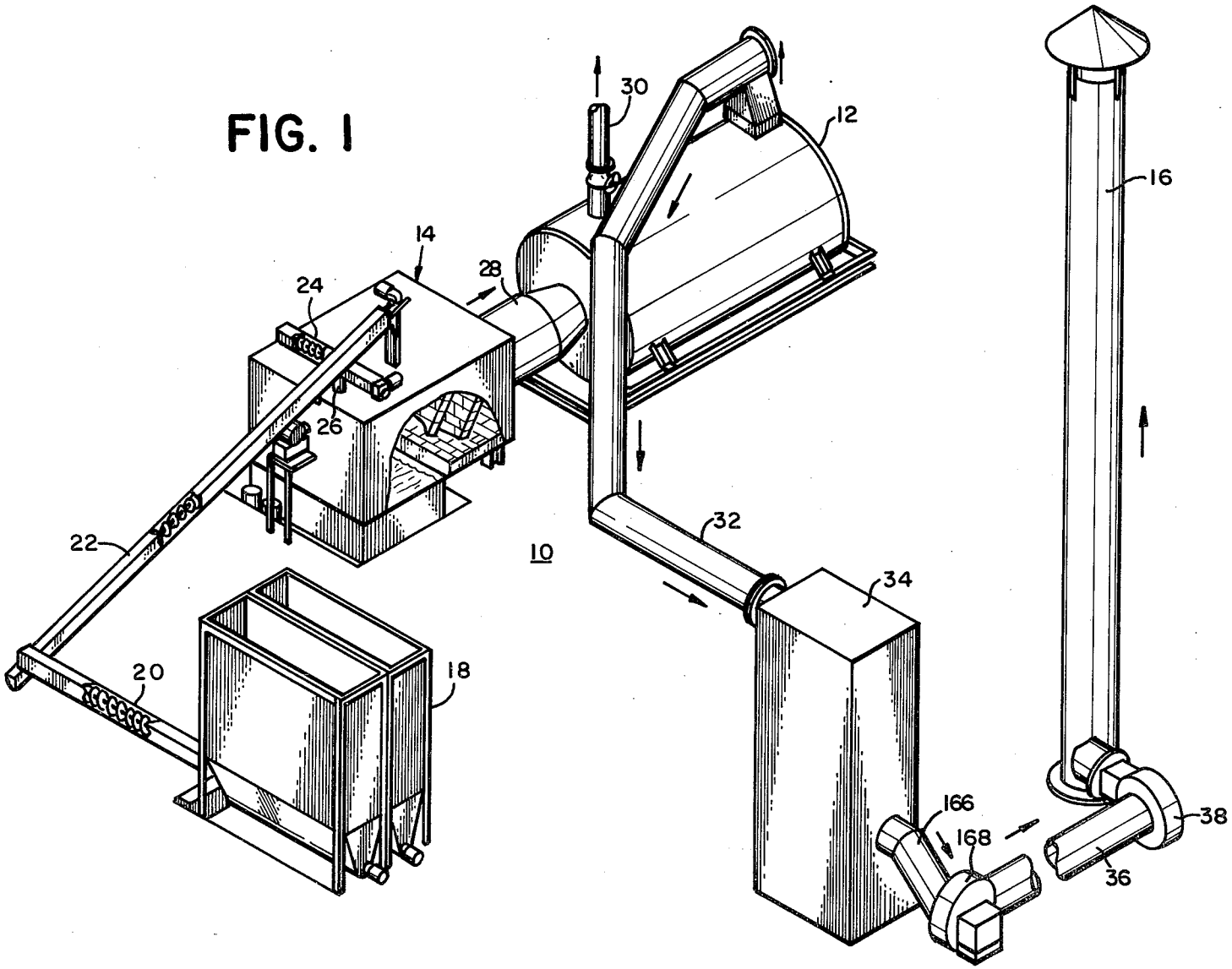
FIG. 1 is a perspective view of the waste material incineration system.

Referring now to FIG. 1, there is shown waste material incinerator system 10 for maximizing the combusting efficiency and increasing the amount of useful energy in providing heat to boiler 12 or some like energy consuming unit. In general, the fuel being combusted within furnace 14 may be classified as waste material. However, it is to be understood that the concepts and structure as provided for waste material incinerator system 10 may be used on prepared fuels, such as coal, or other like materials. System 10 is specifically directed to provide a maximization of the temperatures of the combusting gases while simultaneously minimizing the contaminants within the exhausted gases which are passed to the atmosphere through exhaust stack 16. As will be seen in following paragraphs, the overall energy efficiency increase of waste material incinerator system 10 is derived by maintaining the combusting waste material in various combustion zones within furnace 14 for an increased length of time. Additionally, higher temperatures are achieved within the combusting zones of furnace 14 by radiation reflection from the internal walls of furnace 14.

Various contaminants and particulate matter are removed from waste material incinerator system 10 prior to expulsion of exhaust gases through exhaust stack 16 to provide a relatively clean effluent passing to the atmosphere.

Waste material or other type fuel is initially maintained in fuel storage tank 18. Fuel storage tank 18 may be a box-like structure, or of a silo-like contour with waste material passing to conveyor 20 by gravity assist. Fuel or waste materials storage tank 18 may have incorporated therein various material separation mechanisms, such as air classifiers, magnetic separation devices, to delineate combustible material from non-combustible material. Additionally, material may be initially shredded through one of many types of systems, such as a hammer-type mill, or like unit. Conveyor 20 may be a screw type conveyor for displacing waste material from fuel or waste material storage tank 18, as is shown in FIG. 1.

Conveyor 20 interfaces and displaces waste material on inclined screw conveyor 22 which transports the waste material to a positional location above furnace 14. Waste material then passes to horizontal screw conveyor 24 and passes into furnace inlet 26 where the waste material is combusted, as will be described in detail in following paragraphs.

Subsequent to combustion within furnace 14, combusted waste material gases pass through conduit 28 for insert into boiler 12. Water or other liquid within boiler 12 is heated and steam or other vapor material is passed through boiler external conduit 30. Exhaust gases passing from boiler 12 egress through exhaust pipe 32 and are inserted into scrubber mechanism 34 for cleansing particulate materials from the exhaust gases.

Subsequent to passage through scrubber unit 34, the exhaust gases pass through piping 36 and then through exhaust stack 16 for passage to the atmosphere. Induction fan or pump 38 may be mounted at the lower end of exhaust stack 16 to provide a pressure drop differential for the exhaust gases passing through scrubber 34 and to further provide a positive pressure to the gases passing in a vertical manner through exhaust stack 16 to the ambient atmosphere.

It is to be understood that boiler system 12 shown in FIG. 1, is used for illustrative purposes only. Boiler system 12 may be one of many types of energy consuming systems, not important to the inventive concept as herein described. Additionally, fuel storage tank 18 and associated material separation systems are only important for the purposes of this disclosure to provide an overall conceptual image of waste material incinerator system 10. The concept as herein described is directed to maximizing the efficiency of an energy consuming unit while providing a relatively clean effluent passing to the ambient atmosphere.

Referring now to FIGS. 2–5, there is shown furnace 14 of waste material incinerator system 10. System 10 includes furnace 14 extending in longitudinal direction 40 and includes first combustion zone 42 and second combustion zone 44. Waste material is brought into furnace 14 through conveyor 22. Waste material is then inserted on vertical chute 46 and passes to screw conveyor 24 by gravity assist. Waste material is then inserted internal to furnace 14 through furnace inlet 26.

Waste material entering first combustion zone 42 is directed in an intersecting path with flame front 48 of burner 50. Burner 50 may be an oil or gas burner not important to the inventive concept as is herein described, with the exception that flame front 48 should impinge on the waste material being inserted by gravity assist through furnace inlet 26.

First combustion zone 42 includes upper section 52 and lower section 54 with upper section 52 having a larger transverse dimension taken in transverse direction 56 than lower section 54.

Figure 4:
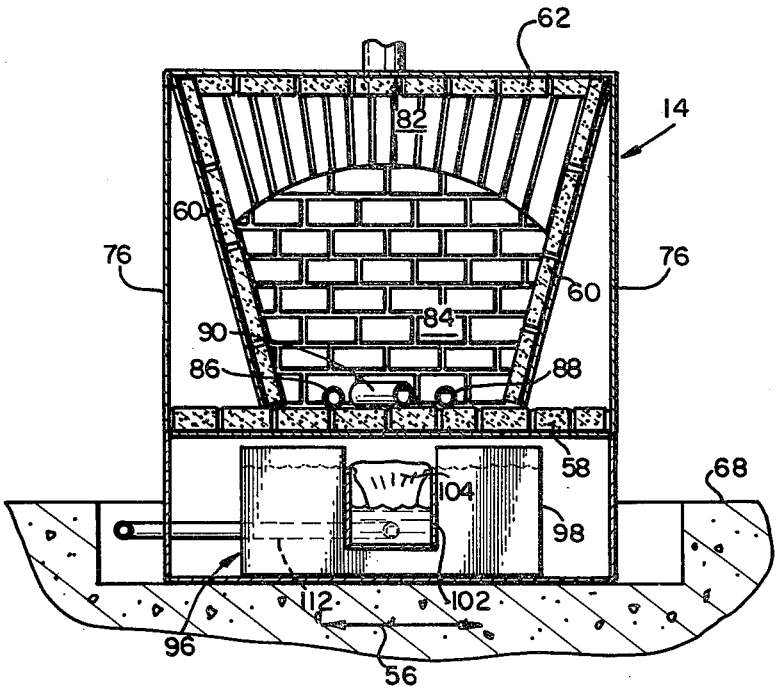
FIG. 4 is a sectional view of the furnace taken along the section line 4—4 of FIG. 2.
Figure 5:
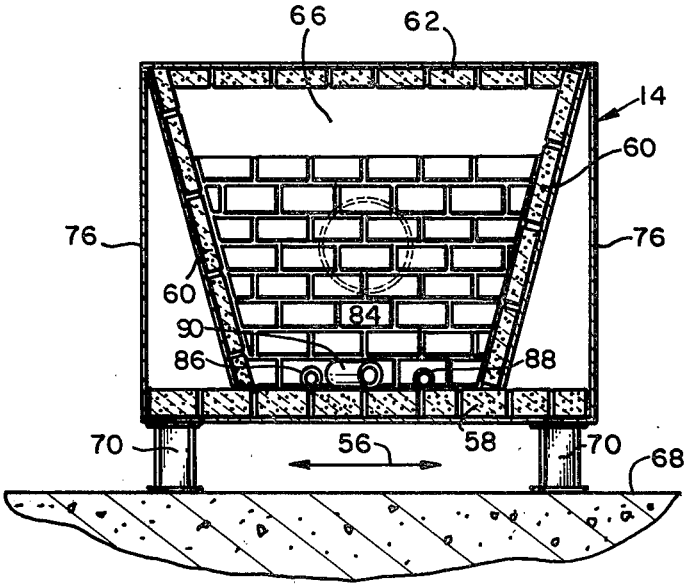
FIG. 5 is a sectional view of the incineration furnace taken along the section line 5—5 of FIG. 2.
Figure 6:
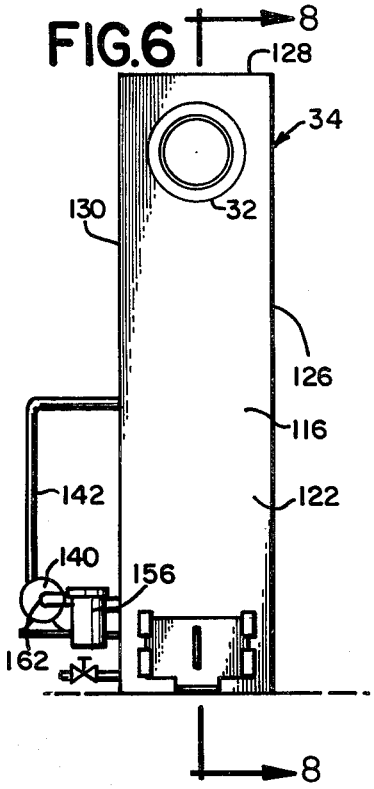
FIG. 6 is an elevation view of the scrubbing unit of the incineration system.
Figure 7:
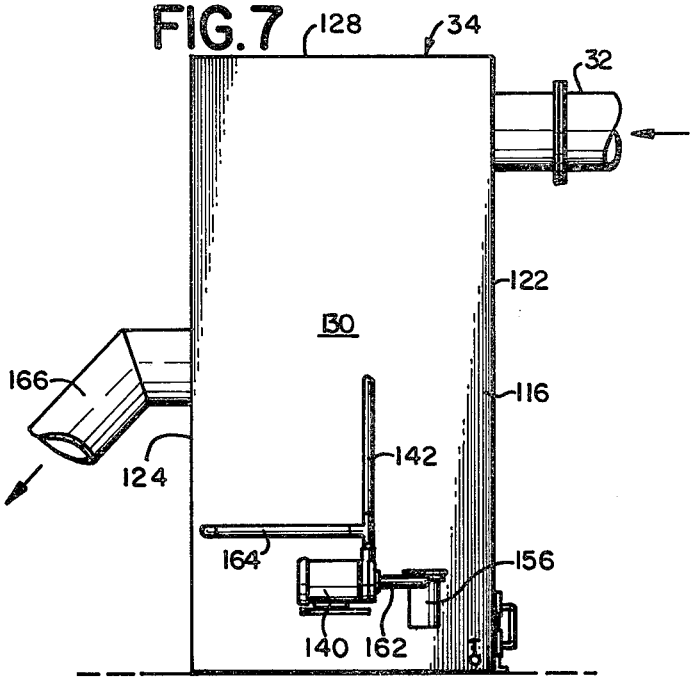
FIG. 7 is a front view of the scrubbing unit.

Furnace 14 includes furnace floor members 58, a pair of furnace sidewalls 60, and furnace top wall 62, as is clearly seen in FIGS. 2, 4 and 5. Frontal and rear walls 64, 66 are displaced each from the other in longitudinal direction 40 to provide a closed contour for furnace 14. Furnace floor member 58 may be mounted to base surface 68 through support angle irons 70 in the manner shown in FIGS. 2 and 5. Additionally, burner 50 may be fixedly secured to frontal wall 64 through bolts, or some like technique, or alternatively, may be mounted on table 72 which in turn is supported through leg 74 on base surface 68.

Furnace internal walls 58, 60, 62, 64 and 66 are formed of an internal layer of fire brick which provides sufficient heat resistance to the combusting material within furnace 14. Additionally, such fire brick provides for a thermal insulation capacity and further allows for reflective radiation to impinge on the combusting waste products to provide higher internal temperatures to the waste material within first and second combusting zones 42 and 44.

Referring further to the geometrical contour of the interior of furnace 14, it is seen in FIG. 4, as well as FIG. 5, that first and second combustion zones 42 and 44 define a predetermined cross-sectional area contour in a plane normal to longitudinal direction 40. Sidewalls 60 are seen to be inclined with respect to a horizontal plane defined by base surface 68 and monotonically decrease from upper section 52 to lower section 54. In particular, the decrease in cross-sectional area is linear in nature and the predetermined cross-sectional area as shown in the Figures is trapezoidal in contour.

Referring to FIGS. 4 and 5, there is shown furnace support outer walls or support members 76 which are rigidly secured to upper portions of furnace 14, as well as floor member 58 on opposing transverse sides of furnace 14. Support members or support walls 76 are provided to give added structural support and stability to furnace 14. Wall or support members 76 may be formed of steel, or some like composition, not important to the inventive concept as herein described, with the exception that such maintain the structural integrity of furnace 14.

One of the main concepts of the subject system 10 is to maintain the combusting waste material inserted through furnace inlet 26 within first combustion zone 42 for a maximization of time to allow a complete combusting or burning of the waste material. The increase of time within which waste material is maintained in first combustion zone 42 is provided partially by maintaining a vortex pattern for the incoming waste material within first combustion zone 42. The particular vortexing pattern shown by vortexing directional arrows 78 in FIG. 2 is provided through a combination of the internal geometry of furnace 14 in combination with preheating air devices to be described in following paragraphs.

Waste material enters internal to furnace 14 through furnace inlet 26 and passes by gravity assist directly into first combustion zone 42. A vortexing pattern defined by vortexing directional arrows 78 brings the waste material into an initial downward flow within zone 42. Waste material is impinged by flame front 48 of burner 50 and continues to fall in a vertical direction into lower section 54 of first combustion zone 42. The inclined and rigid opposing sidewalls 60 force the waste material into a more compact mass and thus there is a densifying of the combusting waste material in lower section 54.

Waste material within vortexing pattern 78 once reaching a lower portion of the overall pattern within lower section 54 is then passed in a clockwise direction, as is taken with reference to FIG. 2, and is then transported from lower section 54 to upper section 52 of first combustion zone 42. Displacement of the waste material in an initial downward direction into lower section 54 densifies the waste material and has been found to provide for a more compact burning mass in the overall system. Additionally, the inclined trapezoidal sidewalls 60 provide for a decreasing cross-sectional area which has been found to increase the velocity in the vortexing pattern 78 within lower section 54. This increasing velocity allows by moment of inertia the maintenance of the vortexing pattern of the overall waste material mass being combusted within first combustion zone 42. As the waste material moves from lower section 54 to upper section 52 of first combustion zone 42, the combusting waste material is permitted to expand and lose some velocity characteristics as the gaseous products reach the upper portion of upper section 52. Gaseous products may then re-enter the vortexing pattern or may be passed to second combustion zone 44 to be further described. Thus, what has been unexpectedly found in system 10, is that there is a first portion of the waste material which is maintained within the vortexing pattern defined by the vortexing directional arrows 78 until a time interval has passed that such waste material has been fully or substantially combusted. Once the waste material has been substantially combusted, it has been found that the gaseous products are released from the first combustion zone 42 and passed into contiguous or second combustion zone 44 of furnace 14.

It is believed that as the waste material passes downwardly in first combustion zone 42 from upper section 52 to lower section 54, that there is produced a Venturi like effect from the combusting waste material. As the waste material passes upwardly within the vortexing pattern 78 from lower section 54 to upper section 52, the unburned or partially combusted particulates would have a higher momentum value than the totally combusted or substantially combusted products of the waste material. This increased momentum would be affected more by the input air devices and possibly the burned gases would expand at a quicker rate and would be released out of the vortexing pattern 78 into contiguous combustion zone 44 in an optimized manner in opposition to the partially combusted waste material which would be maintained in the cyclical contour within the vortexing pattern 78.

Once the partially or substantially combusted waste material exhaust product gases pass from first combustion zone 42, such are directionally displaced through a tortuous path contour within second combustion zone 44. The tortuous path for exhaust product gases are defined by directional arrows 80 to define the path through second combustion zone 44 into exhaust conduit 28. The mechanism for providing the tortuous path contour 80 for the at least partially combusted waste material in second combustion zone 44 includes retaining wall member 82 coupled to furnace top walls 62 of furnace 14 with retaining wall 82 extending in a downwardly directed vertical direction. As shown in FIG. 2, retaining wall member 82 defines the boundary between first combustion zone 42 and contiguous second combustion zone 44. Retaining wall mexber 82 may be secured to furnace top walls 62 by bolting, screws, or some like fixed securement means not important to the inventive concept as herein described. Additionally, retaining wall member 82 may be substantially formed of fire brick or some like composition, similar to the composition of furnace wall members 58, 60, 62, 64 and 66.

Thus, combusted waste material exhaust gas products subsequent to being partially captured in the vortexing pattern described by directional arrows 78 pass beneath retaining wall member 82 after release from the vortexing pattern and are admitted into second combustion zone 44.

Baffle member 84 is positionally located in second combustion zone 44 and is rigidly secured to furnace lower or floor wall member 58 and extends therefrom in a substantially upward vertical direction, as is seen in FIG. 2. Baffle member 84 passes substantially across furnace 14 in transverse direction 56, as is seen in FIGS. 4 and 5. Baffle member 84 may be formed of fire brick, or some like composition simi1ar to the composition for retaining wall member 82 as previously described. Thus, exhaust product gases leaving first combustion zone 42 are directed under retaining wall member 82 and then forced in an inducted pressure drop manner over baffle member 84 prior to passage through exhaust conduit 28.

Baffle member 84 provides for a plurality of advantageous effects within second combustion zone 44. Initially, such baffle member 84 is used as a mechanical knock-out system where particulate material impinges and may be combusted. Additionally, baffle member 84 has been found to be a thermal balance member where the hot gases within stream 80 are dispersed in a transverse manner across second combustion zone 44. This allows a uniformity of temperature for gases within second combustion zone 44. Still further, the rigid structure of baffle member 84 forces the gases in a tortuous path as clearly can be seen in FIG. 2, and thus, retains the gases within second combustion zone 44 for an additional time interval. The additional time interval allows for further combusting of the gases before passage through exhaust conduit 28. Additionally, an unexpected result of the addition of front retaining wall member 82 and baffle member 84 is that it has been unexpectedly found that temperatures within second combustion zone 44 are found to be, in certain instances, surprisingly higher by a few hundred degrees than the temperatures found in first combustion zone 42. The increased temperatures within second combustion zone 44 thus imply some type of exothermic reaction occurring in second combustion zone 44 even though there is no flame impingement directly on the combusting gaseous products.

The vortexing mechanism within first combustion zone 42 has previously been stated to be a function of both the internal geometry of furnace 14 as well as air inlet devices to be now described. Thus, the vortexing concept includes preheating air mechanisms which extend adjacent second combustion zone 44, as is clearly seen in FIGS. 2 and 3. The preheating mechanism includes preheating conduit members 86 and 88 which extend substantially in longitudinal direction 40. Preheating conduit members 86 and 88 extend at least partially within second combustion zone 44 through rear wall 66 and allow egress of air into first combustion zone 42 on an opposing longitudinal end.

The mechanism for preheating includes preheat pressure drop mechanism or fan 92 which is coupled to preheating conduit members 86 and 88 through rear wall 66 for displacing ambient air from the atmosphere through preheating conduit members 86 and 88. Preheat fan 92 draws in ambient air from the atmosphere which is inserted into preheat fan chamber or plenum 94 which is then distributed to conduit members 86 and 88. Air flowing through preheating conduit members 86 and 88 is heated in heat transfer exchange transport by the heat within second combustion chamber 44 and is then inserted into first combustion zone 42 to aid in vortexing pattern 78 of the combusting material within first combustion zone 42. Thus, the combusting material within first combustion zone 42 is provided with a preheated air supply from preheating conduit members 86 and 88 under pressure to maintain combusting waste material within first combustion zone 42 for an extended length of time to allow full or substantially complete combustion of the waste material therein. Preheating conduit members 86 and 88 may be formed of a silicon carbide composition which allows for thermal conductivity properties sufficient to heat the air flowing therethrough while at the same time, maintaining structural integrity under the extreme heating conditions within second zone 44.

The preheating mechanism for air being inserted into first combustion zone 42 further includes a mechanism for helically vortexing the combusting waste material within first combustion zone 42. Helical vortexing includes preheating conduit member 90 inclined with respect to longitudinal direction 40. The inclination of conduit member 90 is clearly seen in FIG. 3, and provides for a stream of preheated air to be inserted with a predetermined velocity into first combustion zone 42 at an angle which provides for a velocity component in transverse direction 56 and causes an increased path dimension in the overall vortexing pattern 78 for the combusting waste material. The helical vortexing permits an additional time retention of the combusting waste material within first combustion zone 42 to aid in more fully combusting and burning the waste material products. Additionally, the concept of inclining conduit member 90 with respect to longitudinal direction 40 aids in increasing the turbulence of the air inserted in combination with the combusting materials. The increase of turbulence allows for greater heat transport to be accomplished throughout the combusting waste material products and provides for more fully combusted material products as well as higher temperatures within first combustion zone 42 than would be normally expected. The combination of conduit members 86 and 88 substantially parallel to longitudinal direction 40 with inclined preheating conduit member 90 appears to cause an interaction and impingement of air streams which aids in the turbulent flow of the combusting waste products to provide the advantages as previously described. Inclined preheating conduit member 90 may be formed of a silicon carbide composition substantially the same as the composition provided for preheating conduit members 86 and 88. Additionally, preheating conduit members 86, 88 and 90 are generally co-planar and are mounted to lower wall 58. Each of conduit members 86, 88 and 90 are in fluid communication with preheat fan chamber 94 which serves as a plenum for preheat fan 92.

In this manner, preheated air having a generally high velocity is inserted into lower section 54 of first combustion chamber 42 to aid in the vortexing pattern 78. Through the combination of geometrical considerations and the preheating air insert mechanism as previously described, combusting waste material is maintained within first combustion zone 42 for a maximization of time to aid in combusting, and simultaneously provides for a turbulent type flow vortexing pattern 78 to aid in increasing the overall temperature within first combustion zone 42 prior to egress of the substantially combusted exhaust products into second combustion zone 44. Exhaust gas products then pass through exhaust conduit 28 for insert into boiler 14 or some other type heat exchange unit not important to the inventive concept as herein described.

Referring now to FIGS. 2, 3 and 4, it is seen that waste material incinerator system 10 includes particulate material removal mechanism 96 for removing particulate material from first combustion zone 42 during operation of furnace 14. Particulate removal mechanism 96 as will be described in following paragraphs operates continuously during operation of furnace 14.

Particulate removal mechanism 96 includes first fluid chamber 98 which is positionally located below first combustion zone 42 and vertically aligned therewith. First fluid chamber 98 is at least partially filled with liquid 100 which may be water, or some like fluid medium. Particulates displaced from first combustion zone 42 fall by gravity assist to the surface of liquid 100 during operation of furnace 14.

Particulate removal mechanism 96 further includes second fluid chamber 102 positionally located adjacent first fluid chamber 98 and having a liquid level lower than the liquid level of liquid 100 in first fluid chamber 98. First fluid chamber 98 and second fluid chamber 102 are in fluid communication each with respect to the other in order to allow fluid 100 to flow from first fluid chamber 98 into second fluid chamber 102.

Weir member 104 fluidly couples first fluid chamber 98 to second fluid chamber 102. In this manner, fluid flows over weir member 104 into second fluid chamber 102, as is clearly seen in FIG. 4. Particulates on the surface of liquid 100 within first fluid chamber 98 are thus transported to second fluid chamber 102.

Filtration system 108 is fluidly coupled to second fluid chamber 102 for filtering particulates from liquid contained in second fluid chamber 102. Filtration system 108 is coupled to second fluid chamber 102 through filtration conduit 106, seen in FIG. 3. Fluid flows through filtration system 108 and then passes through egress conduit 114 into and through filtration pump 110 which provides the pressure drop to draw liquid through filtration system 108. A fluid feedback mechanism is provided which is coupled to filtration pump 110 and first fluid chamber 98 on opposing ends thereof. The feedback mechanism includes feedback conduit 112 which is coupled on opposing ends to filtration pump 110 and first fluid chamber 98, as is clearly seen. Thus, fluid and particulates are drawn through filtration system 108 by pump 110 and then the filtered liquid is then fed back through feedback conduit 112 into fluid chamber 98 for continuous use during operation of furnace 14. The filtration system 108 may be one of a number of commercially available systems which include particulate traps or other types of well-known processes for removal of particulate matter from liquid passing therethrough.

Referring now to FIGS. 1, 6–8, there is shown waste material incineration system 10 including scrubber mechanism 34 coupled to exhaust gas pipe 32. Scrubber unit 34 removes particulate material from exhaust gas products subsequent to the passage of the exhaust gas products from second combustion zone 44 and in fact, subsequent to passage through boiler or heat exchange unit 12. Scrubber unit 34 is provided in system 10 for removal of contaminants prior to passage through exhaust stack 16 to the ambient atmosphere.

Scrubber unit 34 includes scrubber housing 116 having scrubber inlet 118 and scrubber outlet 120.

Scrubber housing 116 provides for a closed volume for exhaust gas products entering through exhaust gas pipe 32. Housing 116 includes upper wall members 128 and lower wall member 132 which interfaces with base surface 68. Scrubber inlet section 118 is formed in scrubber frontal wall 122 and outlet section 120 is formed in rear wall member 124. Opposing sidewalls 126 and 130 provide for the closed contour volume for the exhaust gases passing through housing 116.

Internal to scrubber housing 116 there is provided a mechanism for directing the exhaust gas products in a predetermined path between inlet 118 and outlet 120. The concept is to increase the velocity of the exhaust gases from inlet section 118 in order to provide a maximization of the removal of contaminants and particulate materials in the exhaust gas when such is impinged by liquid issuing from spray conduit 134.

Figure 8:
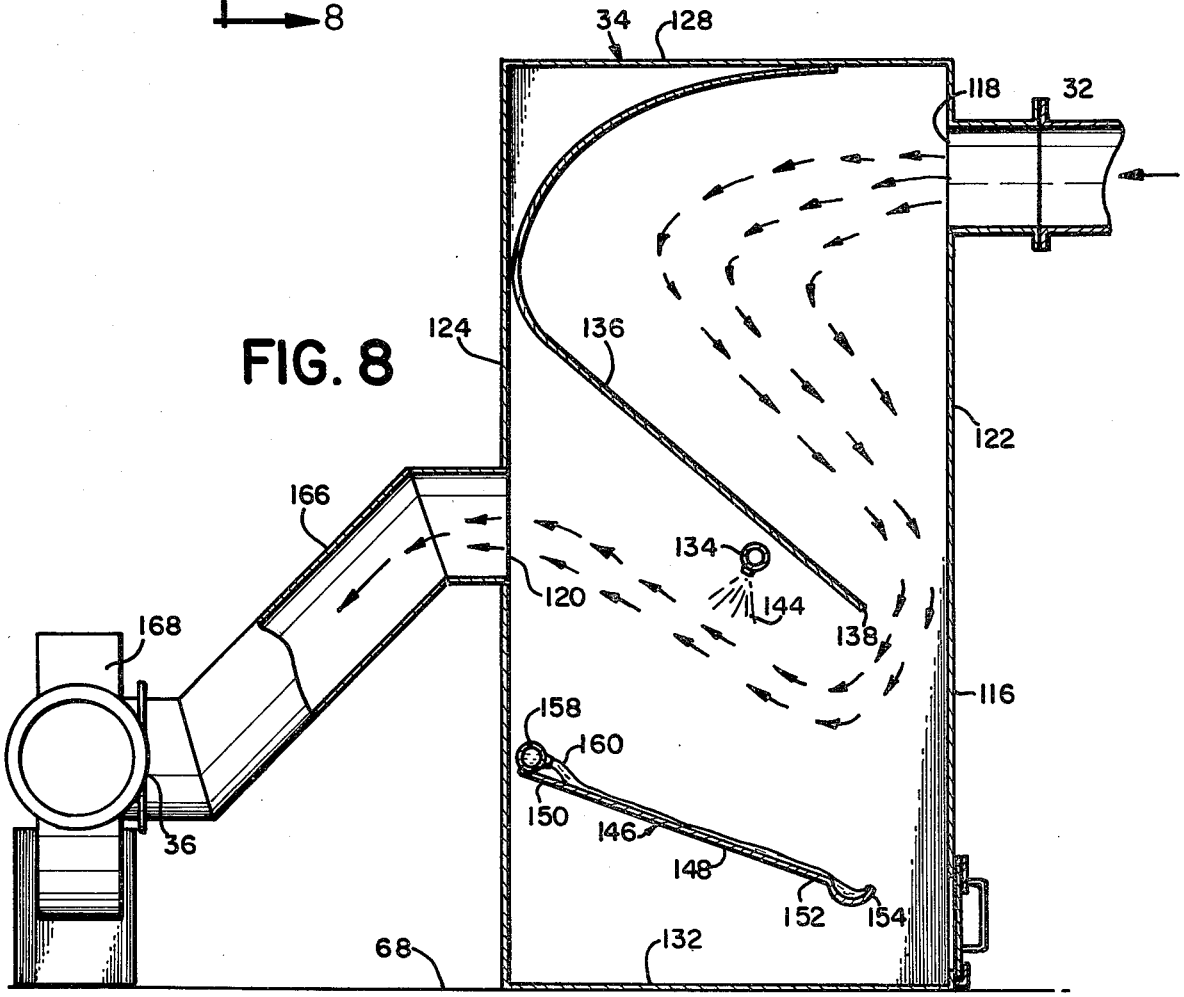
FIG. 8 is a section view of the scrubbing unit taken along the section line 8—8 of FIG. 6.

Arcuately directed vane member 136 is rigidly secured to housing 116 to provide an increase of the velocity of the exhaust gas products subsequent to entrance through scrubber inlet 118. Arcuate vane 136 is fixedly secured to upper wall 128 and as is clearly seen in FIG. 8, provides for a large cross-sectional area in a plane normal to scrubber inlet section 118. Vane member 136 is arcuately contoured to provide a vane end section 138 which lies in proximity to scrubber front wall 122. The cross-sectional area between end 138 and front wall 122 is considerably smaller than the cross-sectional area of the exhaust gas flow near the inlet 118. Thus, there is provided a Venturi effect of the gaseous flow products where end section 138 takes in a nozzle-like effect to provide an increased velocity of the gases flowing therethrough.

In this manner, vane member 136 includes a vane inlet cross-sectional area which is greater than the vane member outlet cross-sectional area to increase the overall velocity of the gaseous products flowing through housing 116 when taken with respect to the flow through exhaust gas pipe 32. Arcuate vane 136 passes throughout the volume of housing 116 and is secured to opposing sidewalls 126 and 130. Arcuate vane member 136 provides for a tortuous path direction for the exhaust gas products passing internal the scrubber housing 116.

Scrubber unit 34 also includes a mechanism for impinging the exhaust gas products with a liquid at a predetermined location in the path of the exhaust gas products as they pass through housing 116 subsequent to flow around vane end section 138, as is shown in FIG. 8. Spray pump 140 passes liquid through spray conduit 142 which passes internal scrubber housing 116 through scrubber sidewall 130. Spray conduit 142 fluidly communicates with internal spray conduit 134 having openings formed therethrough for emission of liquid 144 into the exhaust gas product stream, as such passes around vane end section 138 and is directed to scrubber outlet 120. Internal spray conduit 134 is positionally located in a predeterxined location in order to spray liquid 144 on the gaseous products at a predetermined angle relative to flow direction of the exhaust gas products. In particular, spray 144 is positionally located to provide a normal contact of liquid 144 with respect to the flow direction of the exhaust gases subsequent to their passage around end section 138 of arcuate vane 136. The combination of the increased velocity of the exhaust gases and the substantially normal impingement of spray liquid 144 has been found to provide for particulates and other contaminants being captured in spray liquid 144 and aids in their removal as the spray falls by gravity assist.

Removal of contaminants and other particulates is facilitated by particulate removal mechanism 146 positionally located below internal spray conduit 134 and the exhaust gas flow. Scrubber particulate mechanism 146 includes inclined plate member 148 having upper end portion 150 and lower end portion 152. Plate lower portion 152 includes run-off conduit 154 coupled to filtration system 156 shown in FIG. 7.

Internal particulate removal conduit 158 passes between sidewalls 126 and 130 and emits a flow of fluid 160 onto inclined plate 148. Fluid 160 has impinged upon it the spray 144 containing contaminants and other particulate material and causes such to pass downwardly along inclined plate 148 into run-off conduit 154 where such is fluidly coupled to scrubber filtration system 156 externally located with respect to scrubber housing 116. Filtered fluid then is drawn through pipe 162 for insert into spray pump 140. Fluid being emitted from spray pump 140 passes through spray conduit 142 and coupling conduit 164 which is in fluid communication with internal particulate removal conduit 158. In this manner, there is provided a feedback system for liquid passing from internal spray conduit 134 and internal particulate removal conduit 158. The filtration system 156 may be similar in nature to filtration system 108 provided for furnace 114.

In this manner, exhaust gases in a relatively cleansed state, pass through scrubber outlet 120 into egress conduit 166 for passage through egress fan 168 into piping 36 for disposal to the ambient atmosphere through exhaust stack 16.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. A waste material incineration system comprising:

(a) a longitudinally directed furnace having a first combustion zone and a second combustion zone, said waste material being inserted into said first combustion zone;

(b) means for helically vortexing said waste material about an axis line substantially normal said longitudinal direction within said first combustion zone, said helical vortexing means including means for inserting preheated air into said first combustion zone, said preheating air means extending adjacent said second combustion zone for discharging at least a portion of said preheated air into a lower section of said first combustion zone at an inclined angle with respect to said longitudinal direction; and, (c) means for removing particulate material from said first combustion zone.

2. The waste material incineration system as recited in claim 1 where said furnace first combustion zone includes an upper section and a lower section, said upper section having a larger transverse dimension than said lower section.

3. The waste material incineration system as recited in claim 2 where said furnace first combustion zone defines a predetermined cross-sectional area contour normal said longitudinal direction, said cross-sectional area contour being monotonically decreased from said upper section to said lower section.

4. The waste material incineration system as recited in claim 3 where said predetermined cross-sectional area is substantially trapezoidal in contour.

5. The waste material incineration system as recited in claim 2 where said means for preheating said air includes at least one preheating conduit member extending in said substantially longitudinal direction, said preheating conduit member extending at least partially within said second combustion zone.

6. The waste material incineration system as recited in claim 5 where said means for preheating said air includes preheat pressure drop means coupled to said preheating conduit member for displacing ambient air through said preheating conduit member.

7. The waste material incineration system as recited in claim 6 where said preheat pressure drop means includes a preheat fan member secured to an external wall of said furnace and aligned with one end of said preheating conduit member for discharge of ambient air through said conduit member.

8. The waste material incineration system as recited in claim 7 where said preheating conduit member is formed of a silicon carbide composition.

9. The waste material incineration system as recited in claim 2 where said means for helically vortexing includes at least one preheating conduit member extending in an inclined direction with respect to said longitudinal direction.

10. The waste material incineration system as recited in claim 9 including a multiplicity of preheating conduit members extending substantially in said longitudinal direction.

11. The waste material incineration system as recited in claim 10 including a pair of preheating conduit members positionally located on opposing sides and in transverse displacement with respect to said inclined preheating conduit member.

12. The waste material incineration system as recited in claim 10 where said multiplicity of said preheating conduit members are substantially coplanar each with respect to the other.

13. The waste material incineration system as recited in claim 10 where said means for preheating said air includes preheat pressure drop means coupled to said multiplicity of preheating conduit members for displacing ambient air through said preheating conduit members.

14. The waste material incineration system as recited in claim 2 where said furnace includes means for providing a tortuous path contour for at least partially combusted material in said second combustion zone of said furnace.

15. The waste material incineration system as recited in claim 14 where said tortuous path contour means includes a retaining wall member coupled to an upper wall of said furnace, said retaining wall member extending in a substantially vertical direction.

16. The waste material incineration system as recited in claim 15 where said retaining wall member defines a boundary between said first and second combustion zones.

17. The waste material incineration system as recited in claim 16 where said at least partially combusted waste material products are passed below said retaining wall member.

18. The waste material incineration system as recited in claim 14 where said tortuous path contour means includes a baffle member positionally located in said second combustion zone, said baffle member being secured to a lower wall of said furnace and extending therefrom in a substantially vertical direction.

19. The waste material incineration system as recited in claim 2 where said particulate removal means includes a first fluid chamber positionally located below said first combustion zone, said first fluid chamber being at least partially filled with liquid, said particulates being displaced from said first combustion zone to a surface of said liquid through gravity assist.

20. The waste material incineration system as recited in claim 19 where said particulate removal means includes a second fluid chamber, said first and second fluid chambers being in fluid communication.

21. The waste material incineration system as recited in claim 20 including a weir member for fluidly coupling said first fluid chamber to said second fluid chamber, said particulates on said surface of said liquid in said first fluid chamber being transported to said second fluid chamber.

22. The waste material incineration system as recited in claim 21 where said particulate removal means includes filtration means fluidly coupled to said second fluid chamber for filtering said particulates from said liquid contained in said second fluid chamber.

23. The waste material incineration system as recited in claim 22 including pump means coupled to said filtration means for transporting said particulates and said liquid through said filtration means.

24. The waste material incineration system as recited in claim 23 including fluid feedback means coupled to said pump means for returning said filtered liquid to said first fluid chamber.

25. The waste material incineration system as recited in claim 24 where said fluid feedback means includes a liquid conduit member coupled on opposing ends thereof to said pump means and said first fluid chamber.

26. The waste material incineration system as recited in claim 1 including scrubber means for removing particulate material from exhaust gas products subsequent to passage of said exhaust gases from said second combustion zone.

27. The waste material incineration system as recited in claim 26 where said scrubber means includes:

(a) a scrubber housing having an inlet and an outlet:

(b) means for directing said exhaust gas products in a predetermined path between said inlet and said outlet of said scrubber housing; and, (c) means for impinging said exhaust gas products with a liquid at a predetermined location in said path of said exhaust gas products.

28. The waste material incineration system as recited in claim 27 where said means for directing said exhaust gas products includes means for increasing the velocity of said exhaust gas products subsequent to entrance of said exhaust gas products at said inlet of said scrubber housing.

29. The waste material incineration system as recited in claim 28 where said means for increasing said exhaust gas products velocity includes venturi means internally coupled to said scrubber housing.

30. The waste material incineration system as recited in claim 29 where said venturi means includes a vane member having a vane inlet cross-sectional area greater than a vane outlet cross-sectional area.

31. The waste material incineration system as recited in claim 30 where said vane member is arcuately contoured for providing a tortuous path direction for said exhaust gas products internal said scrubber housing.

32. The waste material incineration system as recited in claim 28 where said liquid impingement means includes liquid spray means for spraying said exhaust gas products subsequent to the velocity of said exhaust gas products being increased internal said scrubber housing.

33. The waste material incineration system as recited in claim 32 where said liquid spray means impinges said exhaust gas products at a predetermined angle relative to the flow direction of said exhaust gas products.

34. The waste material incineration system as recited in claim 33 where said liquid spray direction is substantially normal to said flow direction of said exhaust gas products.

35. The waste material incineration system as recited in claim 27 including scrubber particulate removal means internal said scrubber housing, said scrubber particulate removal means being positionally located below said liquid impingement means.

36. The waste material incineration system as recited in claim 35 where said scrubber particulate removal means includes:

(a) an inclined member having an upper end portion and a lower end portion, said inclined member being located below said liquid impingement means; and, (b) liquid flow means coupled to said upper end portion of said inclined member for discharging liquid to said inclined member.

37. The waste material incineration system as recited in claim 36 including:

(a) means for filtering particulate material from said liquid passing from said lower end portion of said inclined member; and, (b) means for pumping liquid from said filtering means to (1) said liquid impingement means, and (2) said scrubber particulate removal means.

38. A waste material incineration system comprising:

(a) a longitudinally directed furnace having a first combustion zone and a second combustion zone, said waste material being inserted into said first combustion zone;

(b) means for helically vortexing said waste material about an axis line substantially normal said longitudinal direction within said first combustion zone, said helical vortexing means including means for including preheated air into said first combustion zone for discharging at least a portion of said preheated air into a lower section of said first combustion zone at an inclined angle with respect to said longitudinal direction, said waste material being at least partially combusted in said first combustion zone and passed to said second combustion zone; and, (c) scrubber means for removing contaminants and particulate material from exhaust gas products subsequent to passage of said exhaust gas products through said second combustion zone.

39. The waste material incineration system as recited in claim 38 where said scrubber means includes:

(a) a scrubber housing having an inlet section and an outlet section;

(b) means for directing said exhaust gas products in a predetermined path between said inlet section and said outlet section; and, (c) means for impinging said exhaust gas products with a liquid within said path of said exhaust gas products.

40. The waste material incineration system as recited in claim 39 where said directing means includes means for increasing the velocity of said exhaust gas products flow subsequent to entrance of said exhaust gas products at said inlet section of said scrubber housing.

41. The waste material incineration system as recited in claim 40 where said means for increasing said exhaust gas products flow velocity includes venturi means internally secured to said scrubber housing.

42. The waste material incineration system as recited in claim 41 where said venturi means includes a vane member having a vane inlet cross-sectional area greater than a vane outlet cross-sectional area.

43. The waste material incineration system as recited in claim 42 where said vane member is arcuately contoured for providing a tortuous path direction for said exhaust gas products internal said scrubber housing.

44. The waste material incineration system as recited in claim 40 where said liquid impingement means includes liquid spray means for spraying said exhaust gas products subsequent to the velocity of said exhaust gas products being increased internal said scrubber housing.

45. The waste material incineration system as recited in claim 44 where said liquid spray direction is substantially normal to said flow direction of said exhaust gas products.

46. The waste material incineration system as recited in claim 39 including particulate removal means internal said scrubber housing, said scrubber particulate removal means being positionally located below said liquid impingement means.

47. The waste material incineration system as recited in claim 46 where said scrubber particulate removal means includes:

(a) an inclined plate member having an upper end portion and a lower end portion, said inclined plate member being located below said liquid impingement means; and, (b) liquid flow means coupled to said upper end portion of said inclined plate member for discharging liquid to said inclined plate member.

48. The waste material incineration system as recited in claim 47 including:

(a) means for filtering particulate material from said liquid passing from said lower end portion of said inclined plate member; and, (b) recirculation means for transporting liquid from said filtering means to said liquid impingement means and said scrubber particulate removal means.

* * * * *